United States Patent [19]

Murata et al.

[11] Patent Number: 4,674,430

[45] Date of Patent: Jun. 23, 1987

[54] SHIP WITHOUT TRANSVERSE REINFORCING MEMBERS BETWEEN THE INNER AND OUTER HULL PLATING

[75] Inventors: Seiichiro Murata; Masaru Tateishi, both of Akai; Kohji Hayakawa, Nishinomiya; Takeshi Sakamoto, Suita; Kohsuke Mukasa, Arao, all of Japan

[73] Assignee: Hitachi Zosen Corporation, Osaka, Japan

[21] Appl. No.: 824,524

[22] Filed: Jan. 31, 1986

Related U.S. Application Data

[63] Continuation-in-part of Ser. No. 628,465, Jul. 6, 1984, abandoned.

[30] Foreign Application Priority Data

Jul. 11, 1983 [JP] Japan ..... 58-107854

[51] Int. Cl.[4] ..... B36B 43/06

[52] U.S. Cl. ..... 114/355; 114/74 A

[58] Field of Search ..... 114/355, 72–78, 114/65 R, 65 A, 80, 83, 85, 87, 88; 220/435

[56] References Cited

U.S. PATENT DOCUMENTS

| | | | |
|---|---|---|---|
| 948,196 | 2/1910 | Watson, Sr. | 114/74 A |
| 1,127,153 | 2/1915 | Ambrozy | 114/74 A |
| 1,989,834 | 2/1935 | Watson | 29/151 |
| 2,201,047 | 5/1940 | Moore et al. | 29/155 R |
| 2,364,522 | 12/1944 | Ganteaume | 114/65 A |
| 2,365,770 | 12/1944 | Nebolsine | 114/65 |
| 2,405,590 | 8/1946 | Mason | 109/81 |
| 2,741,208 | 4/1956 | Albiach | 114/79 |
| 2,779,303 | 1/1957 | Cupples | 114/84 |
| 3,085,538 | 4/1963 | Henry | 114/74 |
| 3,109,294 | 11/1963 | Messer | 114/74 A |
| 3,199,174 | 7/1965 | Nilsson et al. | 29/155 |
| 3,213,632 | 10/1966 | Valk et al. | 114/74 A |
| 3,255,724 | 6/1966 | Campbell et al. | 114/73 |
| 3,356,060 | 12/1967 | Field et al. | 114/125 |
| 3,428,013 | 2/1969 | Prew | 114/74 A |
| 3,477,401 | 11/1969 | Hayama | 114/74 A |
| 3,498,249 | 3/1970 | Jones | 114/74 |
| 3,537,415 | 11/1970 | Jackson | 114/74 |
| 3,547,301 | 12/1970 | Ffooks | 114/74 A |
| 3,554,152 | 1/1971 | Campbell | 114/74 R |
| 3,612,333 | 10/1971 | Cowles | 114/74 A |
| 3,659,543 | 5/1972 | Basile | 114/74 |
| 3,797,099 | 3/1974 | Myers | 29/471.3 |
| 3,804,050 | 4/1974 | Iarossi | 114/74 A |
| 3,811,593 | 5/1974 | Bridges et al. | 220/9 LG |
| 3,834,174 | 9/1974 | Strumbos | 62/47 |
| 3,871,319 | 3/1975 | Turner | 114/74 A |
| 3,875,886 | 4/1975 | Glasfeld et al. | 114/74 A |
| 3,894,505 | 7/1975 | Murphy | 114/74 A |
| 3,899,989 | 8/1975 | Glazebrook | 114/84 |
| 3,922,987 | 12/1975 | Tornay | 114/74 A |
| 3,948,198 | 4/1976 | Yamamoto et al. | 114/74 A |
| 3,978,808 | 9/1976 | Cuneo et al. | 114/74 A |
| 4,066,184 | 1/1978 | Cuthbert et al. | 220/9 LG |
| 4,106,424 | 8/1978 | Schuler et al. | 114/74 A |
| 4,228,754 | 10/1980 | Shibata et al. | 114/74 R |
| 4,394,931 | 7/1983 | Cotgreave et al. | 220/453 |

FOREIGN PATENT DOCUMENTS

| | | | |
|---|---|---|---|
| 90784 | 7/1981 | Japan | 114/74 A |
| 170148 | 6/1934 | Switzerland | 189/37 |
| 936834 | 5/1981 | United Kingdom | 52/729 |
| 889520 | 12/1981 | U.S.S.R. | 114/74 A |

*Primary Examiner*—Joseph F. Peters, Jr.

*Assistant Examiner*—C. T. Bartz

*Attorney, Agent, or Firm*—Barnes, Kisselle, Raisch, Choate, Whittemore & Hulbert

[57] ABSTRACT

A transverseless ship has at least its side portions and bottom portion comprised of a double hull construction which comprises an inner hull plating and an outer hull plating connected together only by transverse bulkheads and a plurality of connecting longitudinal members fixed to the bulkheads. The bottom portion of the ship has a space defined by at least two optionally selected connecting longitudinal members and divided by a partition into an upper chamber and a lower chamber. The upper chamber is adapted in its entirety to pass a fluid therethrough. With this structure, external forces acting on the ship are delivered from the connecting longitudinal members to the transverse bulkheads to prevent the inner and outer platings from buckling. The absence of reinforcing transverse members intersecting the connecting longitudinal members assures automatic welding operation with greatly improved efficiency. Since the space defined by the connecting longitudinal members is utilized as a fluid channel, there is no need to provide additional fluid transport piping.

1 Claim, 4 Drawing Figures

SHIP WITHOUT TRANSVERSE REINFORCING MEMBERS BETWEEN THE INNER AND OUTER HULL PLATING

This is a continuation-in-part of our co-pending application Ser. No. 628,465 filed July 6, 1984; now abandoned.

The present invention relates to a transverseless ship, and more particularly to a structure for tankers and like cargo ships. By "transverseless" is meant a structure without reinforcing transverse members.

BACKGROUND AND SUMMARY OF THE INVENTION

With a navigating tanker, various forces act on the hull. For example, the hull itself is subjected to a longitudinal bending moment and torsional forces, the outer bottom plating and the outer side plating to the pressure of water, and the inner bottom plating and side wall of the hold (oil tank) to the load of oil cargo under gravity. To withstand these forces, the hull includes a large number of structural members such as longitudinal members (side longitudinal members, bottom longitudinal members, central girder, etc.) extending longitudinally of the ship and reinforcing traverse members (side reinforcing transverse members, bottom reinforcing transverse members, etc.) provided transversely of the ship. In the case of such a structure, however, longitudinal members and reinforcing transverse members are provided in an intersecting arrangement so that difficulties are encountered in building the hull by automatic work procedures (e.g. automatic welding). To assure automatic work procedures, therefore, we have conceived of a double shell structure which comprises longitudinal members only and includes no reinforcing transverse members. Nevertheless, use of the double shell structure for the hull involves various problems. For example, when the double shell structure is used only for the bottom of a ship of conventional construction, an external force acting on the outer side plating is transmitted to the bottom portion through reinforcing transverse members provided inside the outer side plating, but the inner and outer bottom platings will buckle because the bottom portion has no reinforcing transverse member. Conversely if the double shell structure is used for the side portion only, an external force acting on the bottom and delivered to the side portion through bottom reinforcing transverse members will buckle the inner and outer side platings because the side portion has no vertical reinforcing transverse member.

An object of the present invention is to provide a transverseless ship which has a double shell structure comprising an inner hull plating and an outer hull plating connected thereto by longitudinal members only and which is nevertheless free of the problem of buckling of the inner and outer platings, the double shell structure having an interior space which is advantageously used owing to the absence of reinforcing transverse members.

To fulfill the above object, the present invention provides a transverseless ship comprising at least opposite side portions and a bottom portion each having a double shell structure, the double shell structure comprising an inner hull plating and an outer hull plating connected together only by a plurality of connecting longitudinal members fixed to transverse bulkheads spaced apart longitudinally of the ship except by the transverse bulkheads, the bottom portion having a spaced defined by at least two optionally selected connecting longitudinal members and divided by a partition into an upper chamber and a lower chamber, the upper chamber being adapted in its entirety to pass a fluid therethough.

With the structure described, an external force acting on the hull can be transmitted through the connecting longitudinal members to the transverse bulkheads having sufficient strength to thereby prevent the inner and outer platings from buckling. Since at least one of the spaces defined by the connecting longitudinal members is utilized as a fluid channel, there is no need to provide additional fluid transport piping.

Further because the double shell structure has an inner hull plating and an outer hull plating which are connected together substantially by connecting longitudinal members only, the transverseless ship has the following advantages.

(1) Absence of reinforcing transverse members decreases the number of components, while absence of intersections between the connecting longitudinal members with reinforcing transverse members makes it possible to build the hull by automatic work procedures (e.g. automatic welding) with a greatly improved efficiency, further facilitating perfect inspection of the space defined by the inner and outer hull platings.

(2) Because the connecting longitudinal members have no intersections with reinforcing transverse members, cracking is avoidable that would otherwise result from stress concentration at such intersections.

(3) Spaces defined by the inner and outer hull platings and divided by the connecting longitudinal members only can be utilized as ballast tanks. Moreover, the ballast tank, which is not divided by reinforcing transverse members longitudinally of the ship drains completely with ease.

(4) Even if a flammable liquid or gas should ingress into a space between the inner and outer hull platings owing to damage to the inner plating, the liquid or gas can be easily drawn off from the space to eliminate an explosion hazard since there is no transverse member dividing the space longitudinally of the ship.

(5) Absence of reinforcing transverse members facilitates stress analysis for the hull and assures a rational arrangement of components for a weight reduction.

(6) The double shell structure prevents outflow of cargo oil in the event of a collision with other ship or stranding.

(7) Since the hold has no inside projections such as stiffeners, the inside wall of the hold can be coated, washed or stripped efficiently and properly and is smaller in the surface area to be coated.

Various features and advantages of the present invention will become apparent from the following description of embodiments with reference to the accompanying drawings.

DETAILED DESCRIPTION

Figure 1:
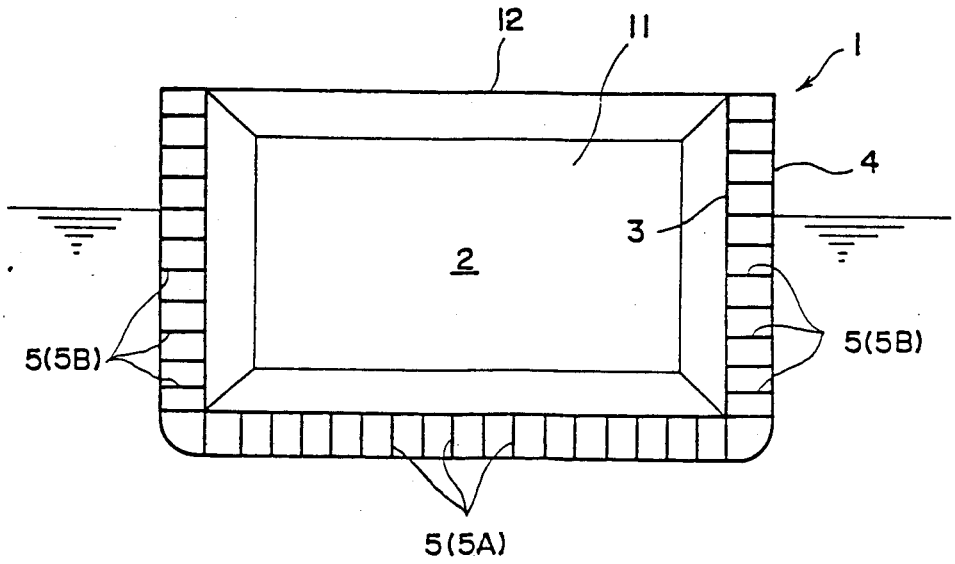
FIG. 1 is a diagram in transverse section schematically showing the overall construction of a transverseless ship according to an embodiment of the invention.

With reference to FIG. 1, indicated at 1 is a transverseless ship such as a tanker. The tanker 1 has opposite side portions and a bottom portion defining holds 2 and each having a double shell structure which comprises an inner hull plating 3 and an outer hull plating. The inner hull plating 3 and the outer hull plating 4 are connected together substantially only by connecting longitudinal members 5 extending longitudinally of the ship.

Figure 2:
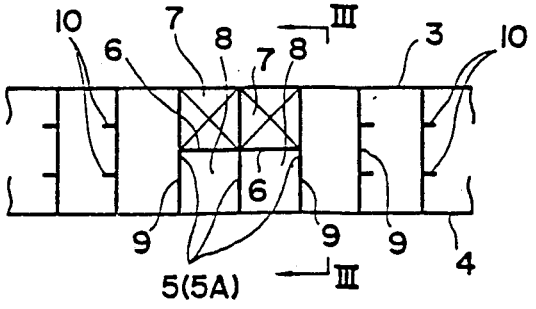
FIG. 2 is a fragmentary diagram in transverse section showing the ship.
Figure 3:
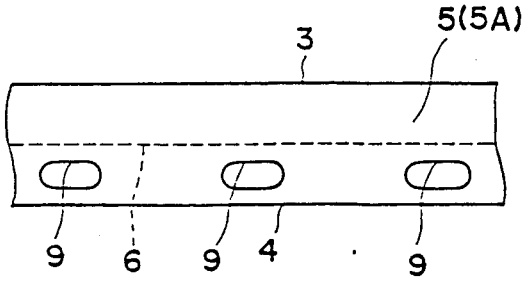
FIG. 3 is a diagram in section taken along the line III—III in FIG. 2.
Figure 4:
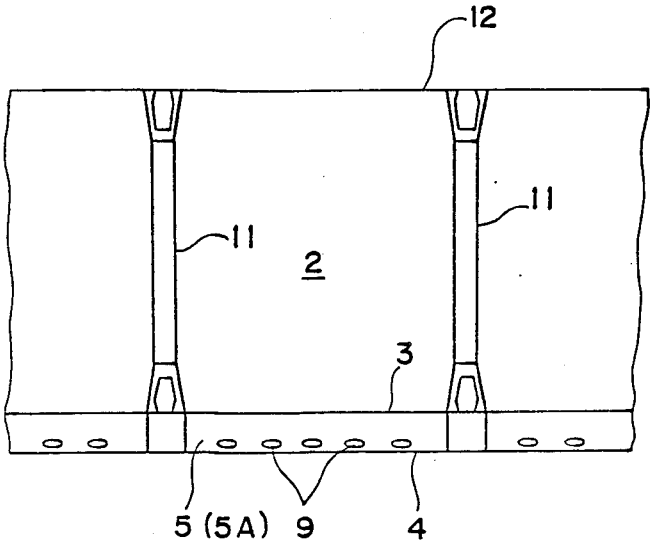
FIG. 4 is a fragmentary diagram of the ship in longitudinal section, taken in the plane of the line III—III in FIG. 2.

As seen in FIGS. 2 and 3, the bottom portion has at the central portion of the ship three adjacent connecting longitudinal members 5A defining two spaces therebetween. Each of the spaces is divided by a partition 6 into an upper chamber 7 and a lower chamber 8. The upper chamber 7 serves in its entirety as a channel for a fluid such as water, oil or the like. Accordingly, the inner hull plating 3, the connecting longitudinal members 5 (only three in the center) and the partitions 6 defining the upper fluid channels 7 are designed to have a thickness sufficient to withstand the internal fluid pressure, with a corrosion allowance considered. Indicated at 9 are weight reduction holes formed in the connecting longitudinal members 5A of the bottom portion, and at 10 are buckling preventing, longitudinal stiffeners attached to the bottom portion connecting longitudinal members 5A other than the three central longitudinal members.

Unlike the conventional hull structure, the double shell structure has no reinforcing transverse members, so that the inner hull plating 3 and the outer hull plating 4 have reduced strength against buckling. To compensate for this, the connecting longitudinal members 5 are provided in a larger number with a smaller spacing. Further because of such arrangement, other small longitudinal members are dispensed with. The force acting on the connecting longitudinal member 5A of the bottom portion will not be delivered to the inner and outer side platings 3, 4 because of absence of reinforcing transverse members. Conversely the force acting on the connecting longitudinal member 5B of the side portion will not be transmitted to the innner and outer bottom platings 3, 4 or to the upper deck portion similarly owing to the absence of reinforcing transverse members. Such forces are all transmitted to the front and rear transverse bulkheads 11 of the hold 2, so that the transverse bulkheads 11 are correspondingly reinforced. For example, the bulkheads 11 are made of corrugated plates so as to withstand forces acting in any direction. When required, structural box members are provided around the bulkheads. The upper deck plating 12 shown has substantially the same structure as heretofore used and is therefore provided with reinforcing transverse members as suitably arranged (not shown).

Although the bottom portion and the opposite side portions only are adapted to have the double shell structure according to the above embodiment, the upper deck portion may, of course, have such a double shell structure similarly. The fluid channels, which are positioned close to the hull center line in the bottom portion, may be positioned closer to one side of the ship. The fluid channels are not always limited to two in number; any number of fluid channels can be provided as required. Furthermore, fluid piping may be provided in the space defined by the connecting longitudinal members 5A.

We claim:

1. A ship having at least its side portions and bottom portion comprised of a double hull construction consisting of an inner hull plating and an outer hull plating connected together by transverse bulkheads and a plurality of plate-to-plate longitudinal members fixed to the transverse bulkheads, the bottom portion of the ship having a space defined by at least two adjacent plate-to-plate longitudinal members, characterized in that (a) there are no transverse members, other than said transverse bulkheads, intersecting said connecting longitudinal members, and (b) said space is divided by a horizontal partition into an upper chamber adapted in its entirety to pass a fluid therethrough and a lower chamber serving as void space, said two adjacent plate-to-plate longitudinal members being provided with weight reduction holes below said partition.

* * * * *